US007156899B1

(12) United States Patent
Hill et al.

(10) Patent No.: US 7,156,899 B1
(45) Date of Patent: Jan. 2, 2007

(54) AREA WIDE MUNICIPAL ELECTRONIC AIR CLEANER AND METHOD

(75) Inventors: Ross K. Hill, Houston, TX (US); Paul J. Grimes, Katy, TX (US); Charles E. Lawrence, Houston, TX (US)

(73) Assignee: Canatxx Energy, L.L.C., Houston, TX (US)

( * ) Notice: Subject to any disclaimer, the term of this patent is extended or adjusted under 35 U.S.C. 154(b) by 172 days.

(21) Appl. No.: 10/833,894

(22) Filed: Apr. 26, 2004

Related U.S. Application Data

(60) Continuation-in-part of application No. 09/840,498, filed on Apr. 23, 2001, now Pat. No. 6,725,621, which is a division of application No. 09/598,182, filed on Jun. 21, 2000, now Pat. No. 6,320,271.

(51) Int. Cl.
*B03C 3/014* (2006.01)

(52) U.S. Cl. ..... 95/67; 95/73; 95/78; 96/44; 96/50; 96/63; 96/88; 290/2; 290/52

(58) Field of Classification Search ..... 96/19, 96/44, 50, 96, 60–63, 88; 95/4, 67, 73, 78; 290/2, 52
See application file for complete search history.

(56) References Cited

U.S. PATENT DOCUMENTS 2,264,495 A * 12/1941 Wilner ..... 361/231
2,786,544 A * 3/1957 Connor ..... 62/272
2,825,102 A * 3/1958 Hicks et al. ..... 422/4
3,043,096 A * 7/1962 McLoughlin ..... 60/286
3,443,362 A * 5/1969 Ebert ..... 96/50
4,675,029 A * 6/1987 Norman et al. ..... 95/73
5,855,652 A * 1/1999 Talley ..... 96/44
6,129,781 A * 10/2000 Okamoto et al. ..... 96/25
6,320,271 B1 * 11/2001 Hill et al. ..... 290/2
6,725,621 B1 * 4/2004 Hill et al. ..... 52/745.02
2001/0029842 A1 * 10/2001 Hoenig ..... 96/63

FOREIGN PATENT DOCUMENTS

EP 376915 * 7/1990 ..... 96/60

* cited by examiner

*Primary Examiner*—Richard L. Chiesa
(74) *Attorney, Agent, or Firm*—The Matthews Firm

(57) ABSTRACT

The present invention provides a power generation facility that is adapted to clean large air masses. Air from the environment, which normally contains the most pollutants, is directed into an air flow path through which large quantities of air are directed by a plurality of large diameter fans. The large air flow is directed through electrically insulated cooling fins which cool heated gas from power generators. The electrically insulated cooling fans have a voltage applied thereto and act as electrodes used to produce an electric field that attracts particles such as pollutants. In a preferred embodiment, a charging section is utilized within the air flow prior to the electrically insulated cooling fins to charge the particles with a charge opposite to the voltage applied to the cooling fins to thereby attract the particles to the cooling fins. A cooling fin washing system with pressurized jets is provided in one embodiment to wash the pollutants from the surface of the cooling fins.

24 Claims, 20 Drawing Sheets

AREA WIDE MUNICIPAL ELECTRONIC AIR CLEANER AND METHOD

RELATED APPLICATION

This application is a continuation in part of U.S. application Ser. No. 09/840,498, filed Apr. 23, 2001 and issued as U.S. Pat. No. 6,725,621 B2, which is a divisional of U.S. application Ser. No. 09/598,182, filed Jun. 21, 2000, and issued as U.S. Pat. No. 6,320,271 B1.

TECHNICAL FIELD

The present invention relates generally to cleaning environmental air and, more specifically, comprises a method for utilizing a large mass air cooling system, such as that found in a power generation facility as taught herein, for electronically cleaning air.

BACKGROUND ART

Industrial and/or consumer electronic air cleaners are well known and extremely efficient. Electronic air cleaners may often remove high percentages, for example up to ninety-nine percent, of particulates, undesirable molecules, and contaminants from the airstream. However, such systems are used to remove contaminants that were added to the air stream during the industrial process. As well, such systems have rather limited air mass flows as compared to the volume of the air mass in the atmosphere over a municipality. In accord with the concepts taught only by the present invention, it would now be desirable and possible to provide a system with a sufficient air stream that substantially the entire air mass within an urban environmental air can be filtered and cleaned.

A presently preferred system utilizes the air mass moving capability of an exemplary air cooled power generation facility suitably designed for use within a municipality, whereby large masses of air are drawn in from the environment and passed over cooling fins, as taught in the related applications listed above and specifically incorporated herein by reference.

Current power generation facilities are constructed with maximum power output in mind, i.e. the machinery is designed first and the structures housing the machinery last. Further, in the prior art, foundations for the power generation equipment are typically set and the power generation equipment installed onto the foundation before the surrounding structures such as walls and roofs are constructed. Prior art power generation facility structures and appearances are utilitarian and designed without regard for appearance or blending into an urban architectural style.

Additionally, due to the size of the machines involved and the amount of energy to be generated, power generation facilities of the prior art tend to be large and built far away from the ultimate consumers who will use the power generated. These large power generation facilities tend to be economically viable only when operated at a more-or-less constant output level and are not easily adaptable to varying power generation in response to widely varying power load requirements of ultimate consumers of the power.

Due to changing market conditions and erratic swings in prices of raw fuels and power, spot markets have developed for power where prices may substantially rise because of a lack of fuel or power and in which at other times prices plunge because of an over supply.

Accordingly, current design power facilities are not appropriate for placement in urban settings. Further, current design criteria force construction of larger plants intended to serve a great number of ultimate consumers who are usually located at some distance from the power generation facility. Further still, many large power generation facilities require extensive use of water, either as a coolant or, in the case of hydroelectric plants, a propellant. Moreover, current design power facilities are not appropriate for widely cycling power generation in response to cycling power needs.

Additionally, a movement is currently underway to provide and/or increase competition among power generation entities. This competition, in turn, will provide impetus for the construction of new, cost efficient power facilities. There is, therefore, a need for new, cost efficient power generation facilities, especially power generation facilities that can be brought online or taken offline or otherwise vary their power output in an economically viable manner.

Large power generation facilities are often powered by higher cost fuels such as pipeline quality natural gas. Gas pipeline delivery systems are often dispersed in and through urban or other population centers in part because these centers were rural forty to fifty years ago but have become urban over time. However, large power generation facilities cannot utilize many of these gas delivery systems because the gas is either of a lower quality or otherwise uneconomic, e.g. gas cost are too high to be used profitably or sufficient quantities of gas are not available.

BRIEF DESCRIPTION OF DRAWINGS

For a further understanding of the nature and objects described herein, reference should be had to the following detailed description, taken in conjunction with the accompanying drawings, in which like elements are given the same or analogous reference numbers and wherein.

GENERAL DESCRIPTION AND PREFERRED MODE FOR CARRYING OUT THE INVENTION

Figure 1:
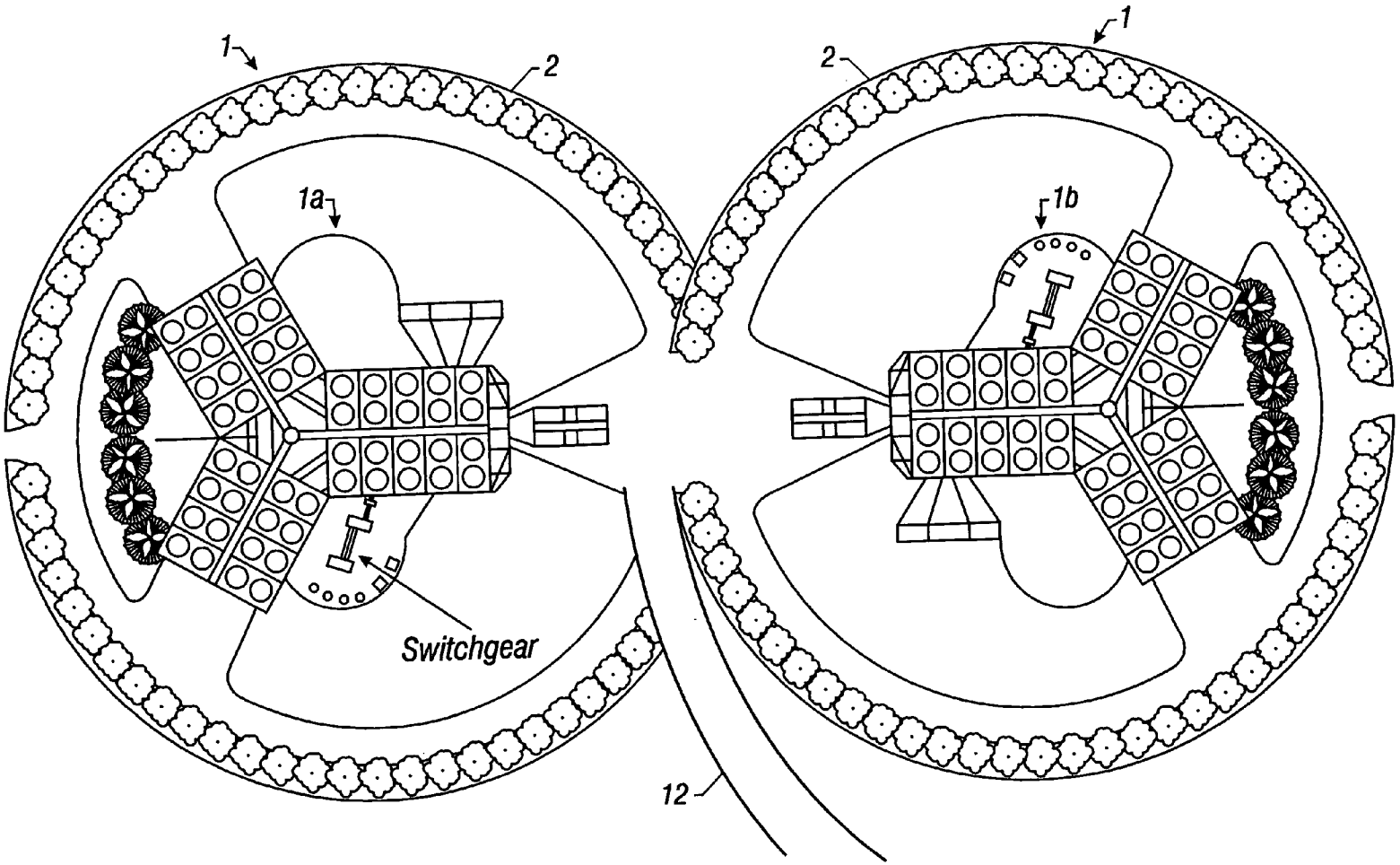
FIG. 1 is a plan view of a representative configuration showing two power generation modules arranged as a single facility.

An air mass moving system as taught herein may conceivably utilize any system for moving extremely large masses of otherwise untreated environmental air through suitable enclosures for electronic filtering. However, for practical reasons, it is desirable that the air mass moving system have a dual purpose that make the air mass system financially feasible without utilizing the system for cleaning the air. Thus, in accord with the present invention, an air mass moving system in accord with the present invention may also be used for the dual purpose cooling or condensing steam or gas produced by power generating equipment. Therefore, it will be appreciated that the fans utilized in accord with the present invention may be in the range of twenty to thirty feet in diameter whereby the fan tips may move at high speeds even though the RPM's may be relatively low. The number of large fans for a single plan may typically be in the range of about forty to sixty, and may be forty-eight in one preferred embodiment. The fans move air to such a large extent that the resulting air may flow hundreds of feet in the air, and perhaps much higher than the height of point discharge systems currently required for some types of installations that produce pollutants. Note that the air flow system, in accord with the present invention, preferably does not introduce any pollutants into the air but only acts to remove large amounts of pollution from the air. In fact, because the intakes of the system are near the ground level where pollution tends to be concentrated, the system takes in large amounts of polluted air and cleans that air.

While the present invention refers generally to FIG. 16 through FIG. 20, and provides for a large air mass electronic cleaner 300, it is instructive to view FIGS. 1–15 to provide an overview of a preferred power generation plant also utilizes the mass air flow system in accord with the present invention. The result is that the air of substantially an entire municipality can be cleaned while simultaneously producing relatively low cost electricity with high efficiency.

Power generation facilities located within urban settings in or near urban centers have advantages over large, remote power generation facilities. However, power generation facilities are not currently located in or near urban centers for numerous reasons including aesthetic, environmental including noise issues, local approval, and economic reasons.

The improved power generation facility, generally referred to by the number "1," embodies a modular approach to the creation of power generation facilities for use as improved power generation facilities 1 that are well suited for placement in urban settings. Further, the improved power generation facility 1 is also well suited for being brought online and taken offline or otherwise varying its power generation on a demand basis while remaining economically viable.

Modular construction of the improved power generation facility 1 may be accomplished by utilizing standardized designs in accordance with the teachings for improved power generation facilities 1. These improved power generation facilities 1 may have a physical size smaller than more remotely located power generation facilities. Further, the improved power generation facility places less demand on local services such as water resources than conventional power generation facilities.

Moreover, in general, all power generation facilities require federal, state, and/or local governmental permits to be constructed and to operate. Most permits encompass air and water quality and usage permitted levels. In urban settings, these governmental permits may be different and further include noise, architectural, and visual requirements as well as zoning and other local ordinances. Further still, local residents' approval may also be required, at least on a political level.

Improved power generation facility 1 is designed to configurably adhere to these permits and regulations and ease obtaining local community-based approval and support, e.g. on a political basis. By way of example and not limitation, these permits and regulations may include or arise from legislated requirements such as those found within United States Electric Utilities Act (16 U.S.C. §824) or United States Public Utility Regulatory Policies Act (16 U.S.C. §2601).

Referring generally to FIG. 1, a plan view of a representative configuration of two power generation modules configured to operate as a single facility, in a preferred embodiment power generation facility 1 is modular to allow incremental provision of electrical power generation capacity at a given physical location. By way of example and not limitation, power generation facility 1*a* may be the first constructed at a site and power generation facility 1*b* may be constructed at that site at a later date to create additional, incremental power appropriate for desired output. This modularity may further allow incremental additions of additional, highly similar power generation facilities 1 at one or more physical locations to achieve greater power capacity if and as necessary. In addition to configurable facades (not shown in FIG. 1), power generation facility 1 may be surrounded by visual and/or audio barriers 2 such as vegetation, including by way of example and not limitation trees and shrubs, walls, natural hills, or any combination thereof.

Figure 2:
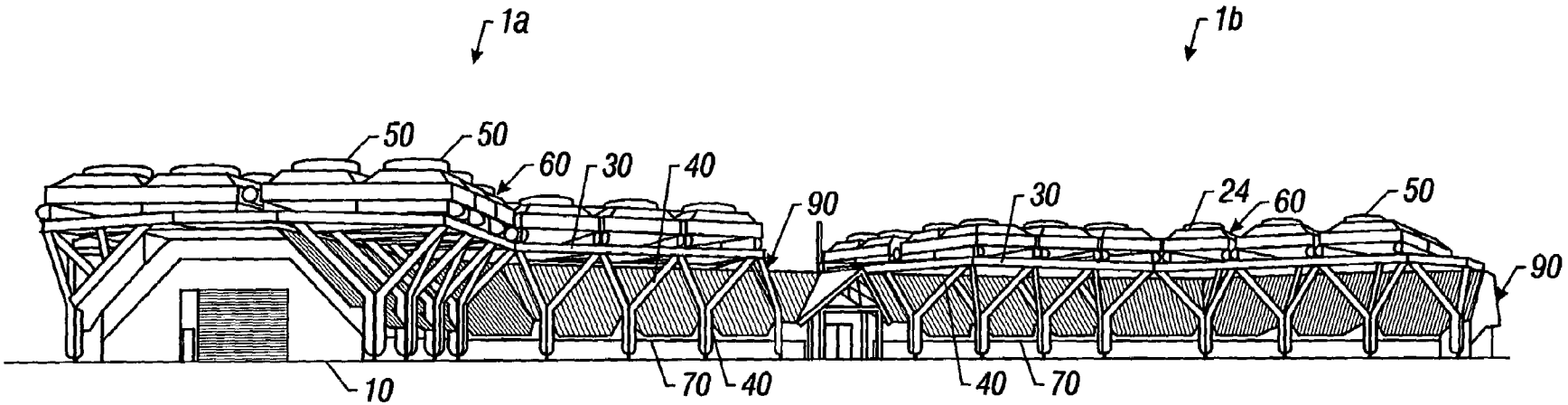
FIG. 2 is a perspective view of a representative configuration of two modular power generation facilities.

Referring now to FIG. 2, a plan view of a representative configuration of two modular power generation facilities, as detailed further herein below, in a preferred embodiment tricolumn legs 40 are securably attached to foundation 10 and allow for onsite construction of support structure 30, the support structure 30 comprising tricolumn legs 40 and providing support for mounting fans 50. Attachment of tricolumn legs 40 may be by any means such as use of bolts and nuts or riveting or the like, thus limiting or removing the need for onsite welding. In the preferred embodiment, components are either constructed at the site, such as foundation 10, or assembled on site, such as support structure 30 which may be bolted together onsite.

Figure 3:
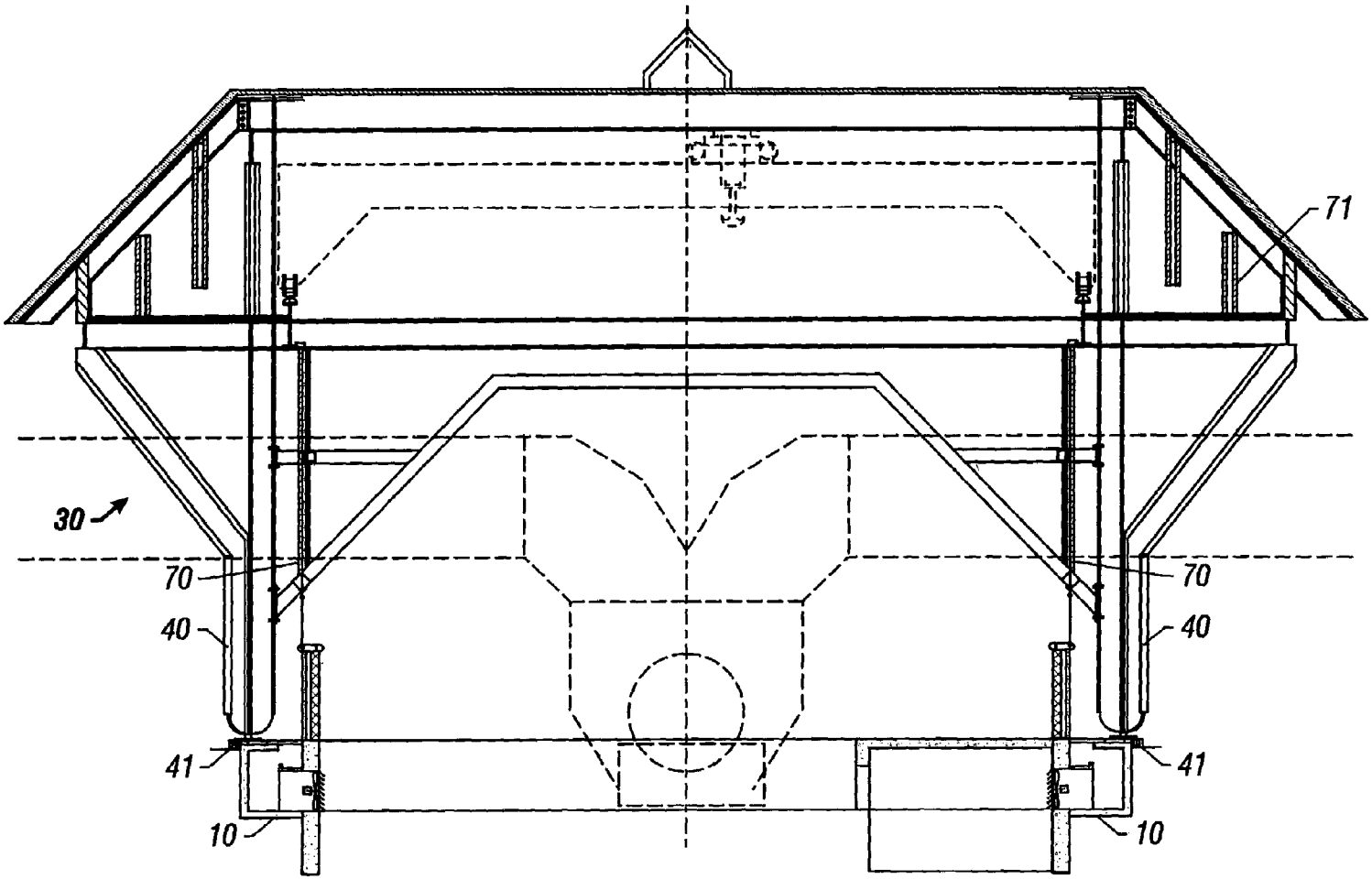
FIG. 3 is a side plan view of a typical side.

Referring now to FIG. 3, a side plan view of a typical side, in the preferred embodiment, Tricolumn legs 40 are fastened to foundation 10 and to each other to allow modular construction of support structure 30. In the preferred embodiment, bolts and nuts may be used as fasteners, but any kind of fastener including rivets, threaded bolts, and welding or any combination thereof may be used. In the preferred embodiment, tricolumn legs 40 are bolted to support pier 41 and support pier 41 is in communication with foundation 10.

Additionally, each tricolumn leg 40 in the preferred embodiment may be individually adjustable with respect to its height using level means such as jackscrews, adjustable members, shims, and the like, all of which will be familiar to those skilled in the construction and leveling arts. In this manner, the entire support structure 30 may be leveled and present a level support platform irrespective of irregularities in foundation 10.

Further, as more fully described herein, walls 70 and ceiling 71 may be suspended from support structure 30, as in the preferred embodiment. The appearance of walls 70 and ceiling 71 may be tailored to a particular location's architectural requirements, allowing the improved power generation facility 1 to "blend" into and be integrated with the overall look of the urban setting into which it is placed.

Figure 4:
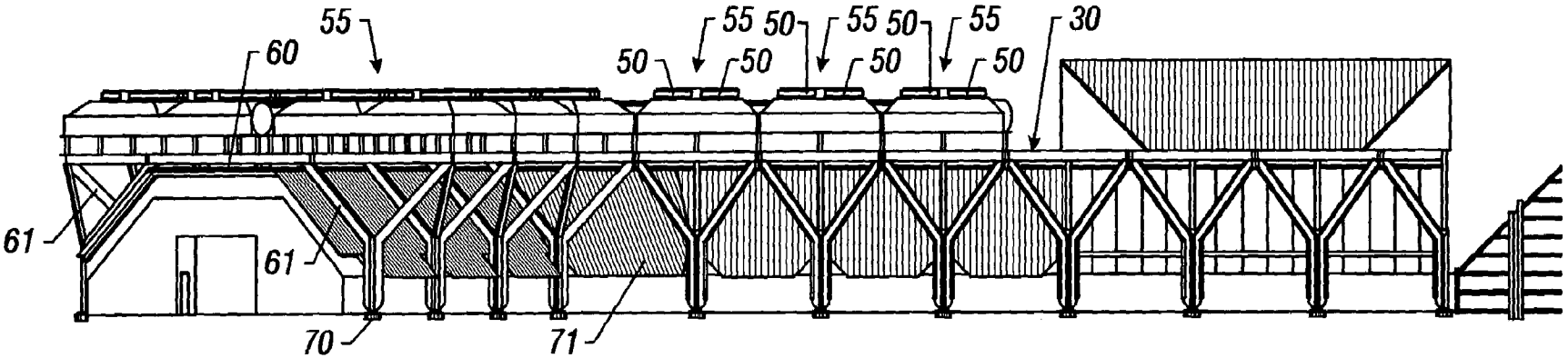
FIG. 4 is an alternate side plan view of a typical side.

Referring now to FIG. 4, an alternate side plan view of a typical side, condenser bays 55 comprise fans 50 and are placed on support structure. Support structure 30, walls 70, and roof 60 are implemented to create air-rise corridor 61 such that improved power generation facility 1 may be at least partially cooled by air flowing through air-rise corridor 61. One air-rise corridor 61 may be present, or, as in the preferred embodiment, at least two air-rise corridors 61 are present per each side of improved power generation facility 1. Further, air-rise corridors 61 act as guide vanes to direct noise attendant to operation of improved power generation facility 1 perpendicularly up and away from improved power generation facility 1. Placement of fans 50 in this manner both ameliorates noise levels and lessens or eliminates the need for coolant water at the improved power generation facility 1.

Figure 5:
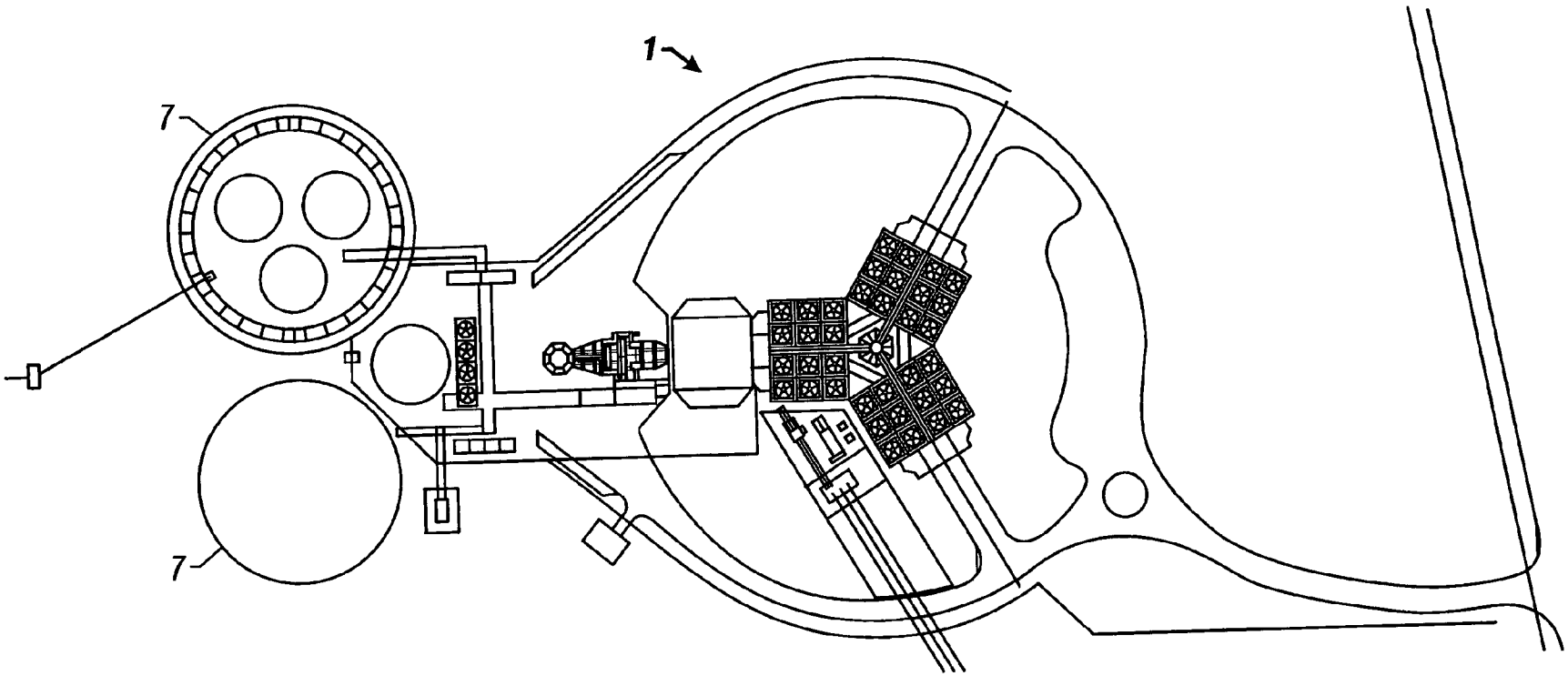
FIG. 5 is a top plan view of an improved power generation facility showing two additional fuel storage tanks.

Referring now to FIG. 5, a top plan view of an improved power generation facility showing two additional fuel storage tanks, because improved power generation facility 1 is modular and sized to a power generation level appropriate for its local ultimate consumers, improved power generation facility 1 may take advantage of use of local power generation materials such as lower quality gas which may be more readily available than pipeline quality gas or other fuels. Improved power generation facility 1 may also take advantage of providing power through lower, so called medium voltage distribution systems already present in the urban setting. To aid in the economic viability of improved power generation facility 1, one or more storage facilities 7 may be constructed or otherwise utilized, allowing operators of improved power generation facility 1 to obtain supplies of fuel when spot or other markets are lower in fuel costs and thereby buffer fuel costs. Storage facilities may include above ground storage tanks, underground storage tanks, tank cars, and the like, or any combination thereof.

Figure 6:
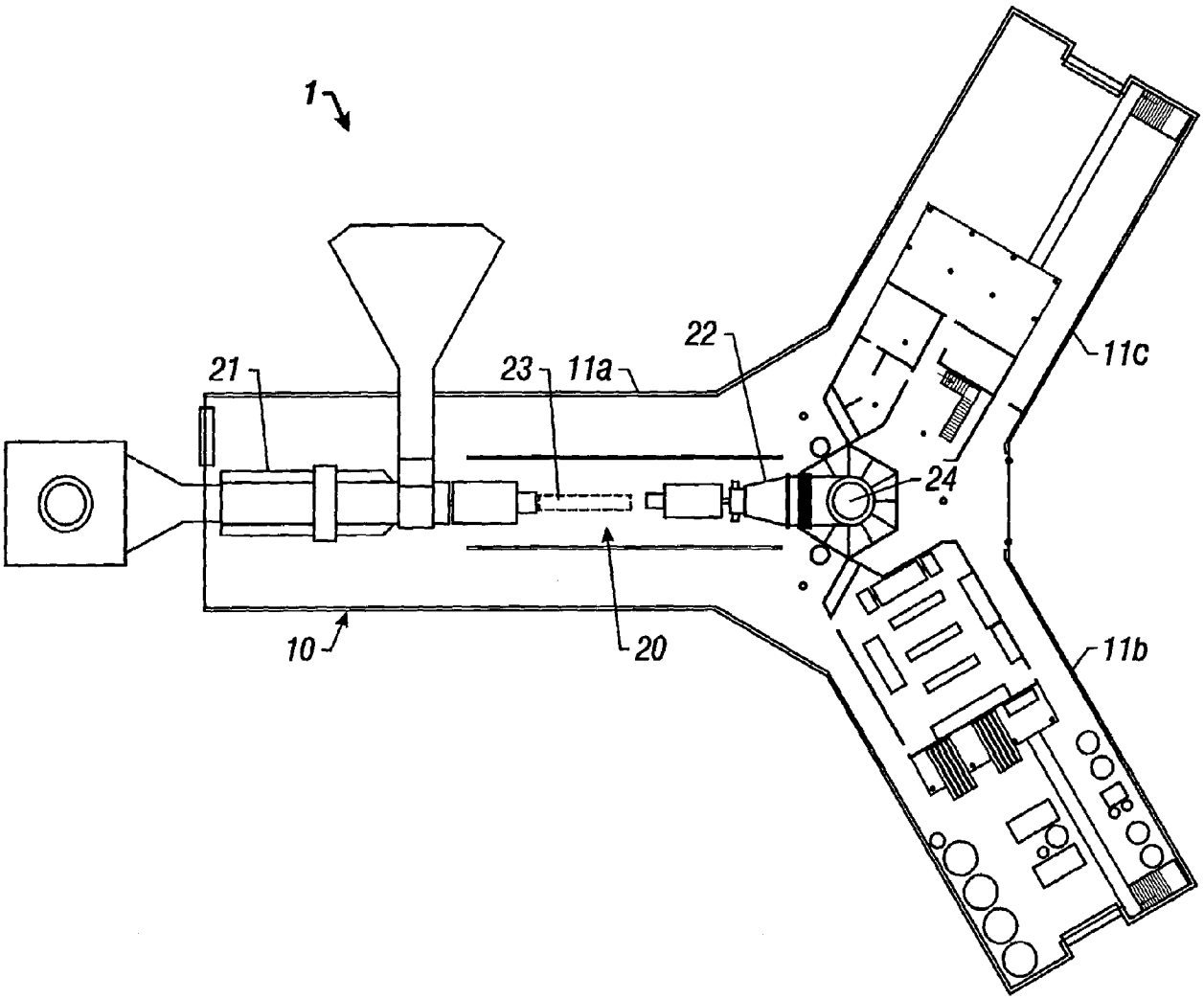
FIG. 6 is a schematic plan view of a representative configuration of a modular power generation facility showing power generation equipment placement.

Referring now to FIG. 6, a plan view of a representative configuration of a modular power generation facility showing power generation equipment placement, foundation 10, in keeping with the modular approach, may be constructed in a predetermined shape. In the preferred embodiment, foundation 10 is configured into a modified "Y" shape having three wings, generally referred to herein as "11": power wing 11*a*, electrical gear wing 11*b*, and shop and locker wing 11*c*. Foundation 10 is sized to support power generation equipment 20 capable of supporting the power requirements of power generation facility 1. Further, foundation 10 may be configured to support two or more stories.

In the preferred embodiment, each power generation facility 1 module is sized to house and contain power generation equipment 20 that provides between one hundred to one hundred fifty megawatts. In the preferred embodiment, power generation equipment 20 comprises gas turbine-generator set 21 and steam turbine-generator set 22 that share a common space within power wing 11*a* for pulling one or more rotors 23. Generator set 21 and steam turbine-generator set 22 may be installed along a central portion of power wing 11*a*. In a preferred embodiment, use of natural gas to power gas turbine set 22 promotes low exhaust emissions and high fuel efficiency, even with lower quality natural gas, e.g. gas having lower BTU characteristics. Further, use of gas turbine-generator set 21 and steam turbine-generator set 22 allows power generation equipment 20 to be cycled on or off in a relatively short time with a relatively short lag time between demand and supply of power. This allows improved power generation facility 1 to be used as an auxiliary power generation facility to help a larger power system buffer peak or other cyclic demands.

In a preferred embodiment, one or more overhead bridge cranes (not shown in FIG. 6) may be deployed proximate a center axis of power wing 11*a* to accommodate installation, service, and maintenance of generator set 21 and steam turbine-generator set 22.

Central core manifold 24 provides a means to transport or otherwise route steam used with gas turbine-generator set 21 and steam turbine-generator set 22 to condenser bays 55. In an alternate embodiment, central core manifold 24 may further comprise a multi-channel ported cooler having a plurality of internal conduits or manifolds and at least one conduit or manifold to contain the a plurality of internal conduits or manifolds.

Figure 7:
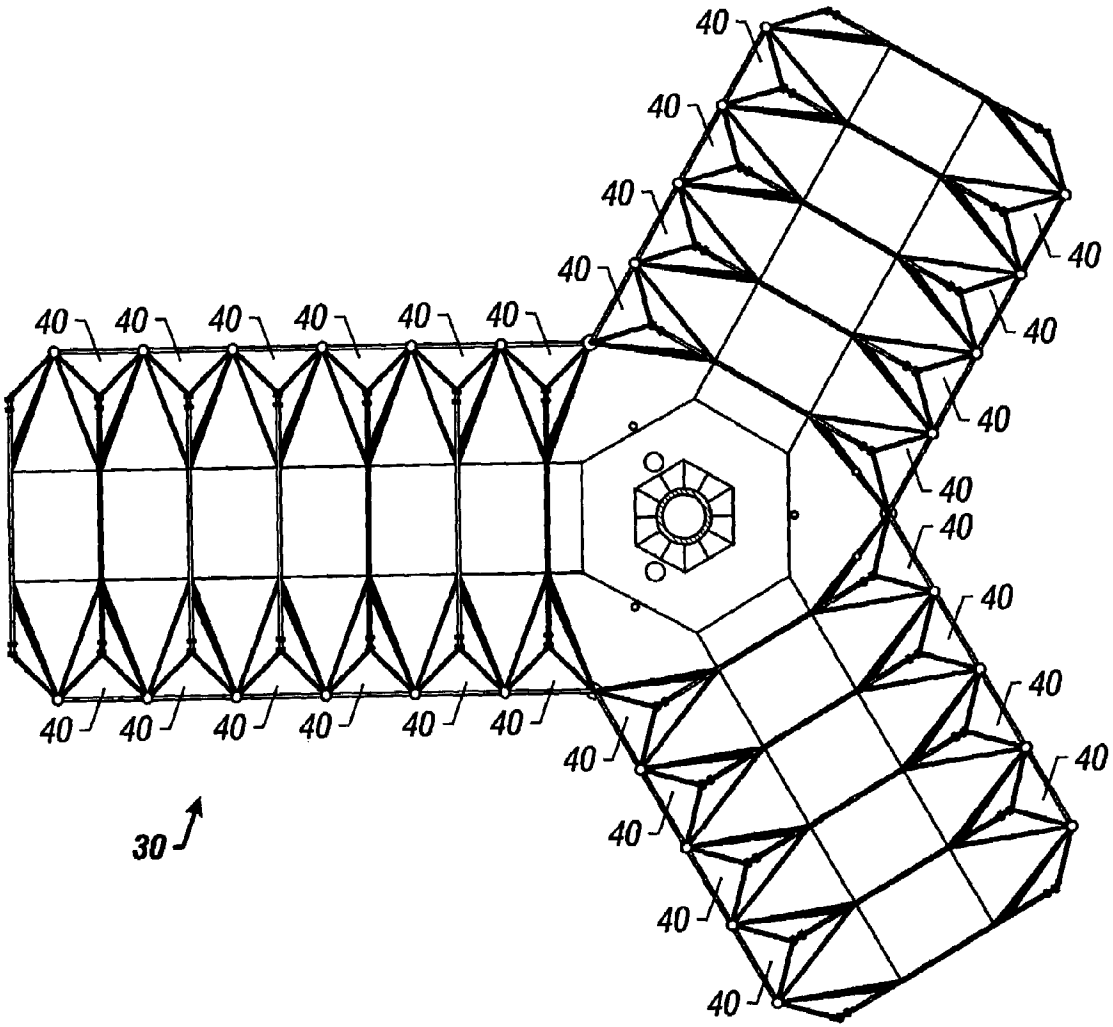
FIG. 7 is a plan view of a representative configuration of power generation facility showing tricolumn legs forming support structure.

Referring now to FIG. 7, a plan view of a representative configuration of power generation facility 1 showing tricolumn legs 40 forming support structure 30, tricolumn legs 40 form support structure 30. The top of support structure 30 is capable of supporting one or more condenser bays 55 (not shown in FIG. 7). In the preferred mode, support structure 30 is assembled from tricolumn legs 40 onsite after foundation 10 is prepared. However, support structure 30 may also be assembled or partially assembled offsite for installation onsite.

Figure 8A:
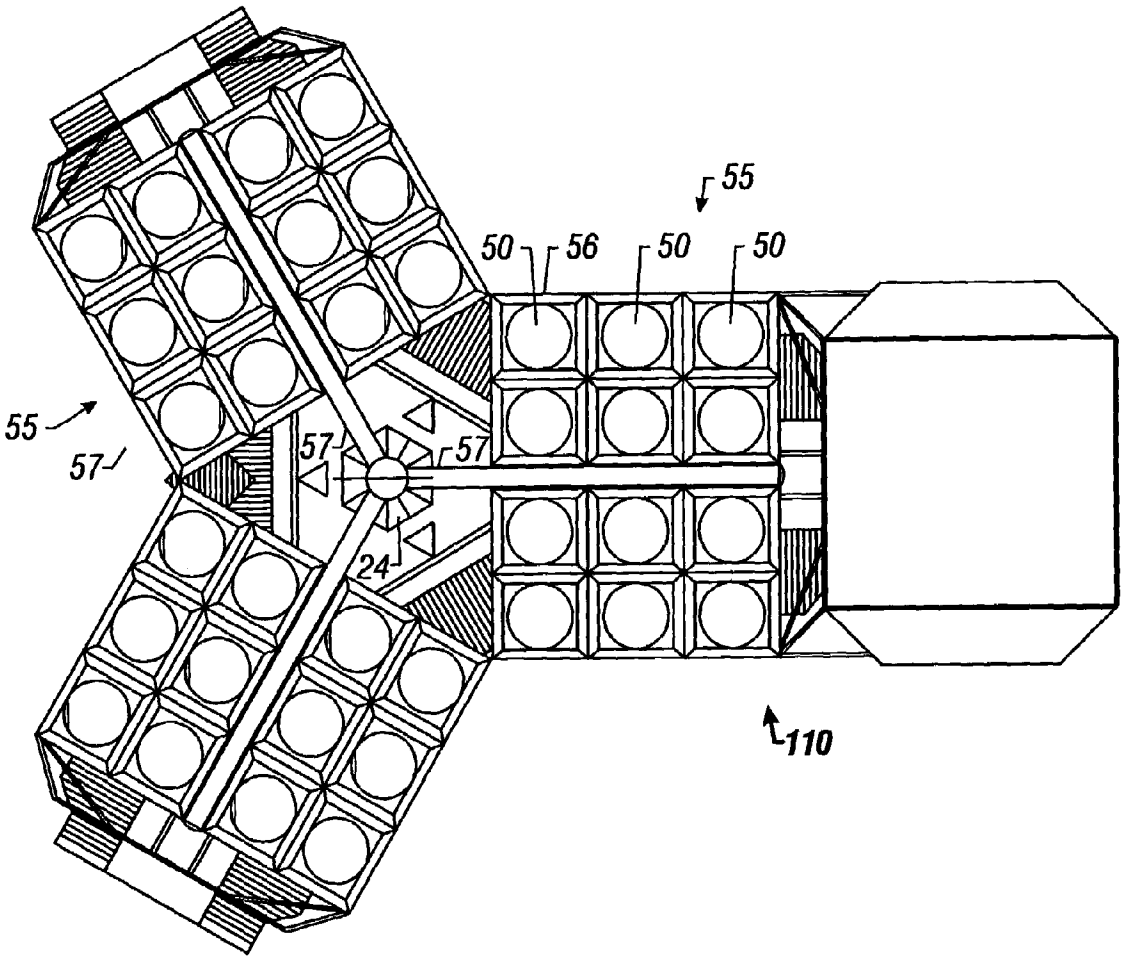
FIG. 8*a* is a plan view of a representative configuration of power generation facility showing placement of condenser bays with cooling fans.

Referring now to FIG. 8*a*, a plan view of a representative configuration of power generation facility 1 showing placement of condenser bays 55 with cooling fans 50, condenser bays 55 operate more efficiently when arranged in a pressure equalizing configuration such as in two or more opposing condenser bays 55. In a preferred embodiment, three condenser bays 55, comprising one or more condenser modules 56, radiate symmetrically from central core manifold 24 and are deployed one per wing 11. Use of condenser bays 55 reduces the length of steam manifold 57 and pressure losses while insuring a balanced load on each condenser module 56.

In a preferred embodiment, one or more cooling fans 50 are integral with condenser modules 56 and condense air used for cooling power generation equipment 20. In the preferred embodiment, two cooling fans 50 are present in each condenser module 56. Use of air cooling instead of water based cooling lessens if not eliminates the need for a ready supply of water, making improved power generation facility 1 well suited for use in environments which lack a ready supply of water. Concurrently, use of air instead of water lessens if not eliminates the need for a local large body of water to which heat and/or chemicals need to be added. Further, water cooled condensers produce vapor plumes which may be unsightly or otherwise undesirable, but the air cooled power generation equipment 20 does not.

Cooling fans 50 may further be controlled such as with computer based controls with respect to speed and other factors to ameliorate sound and noise levels produced during the operation of improved power generation facility 1. One or more control systems 80 (not shown in FIG. 8*a*) may be used to automate or otherwise aid in the controlling of cooling fans 50.

Figure 8B:
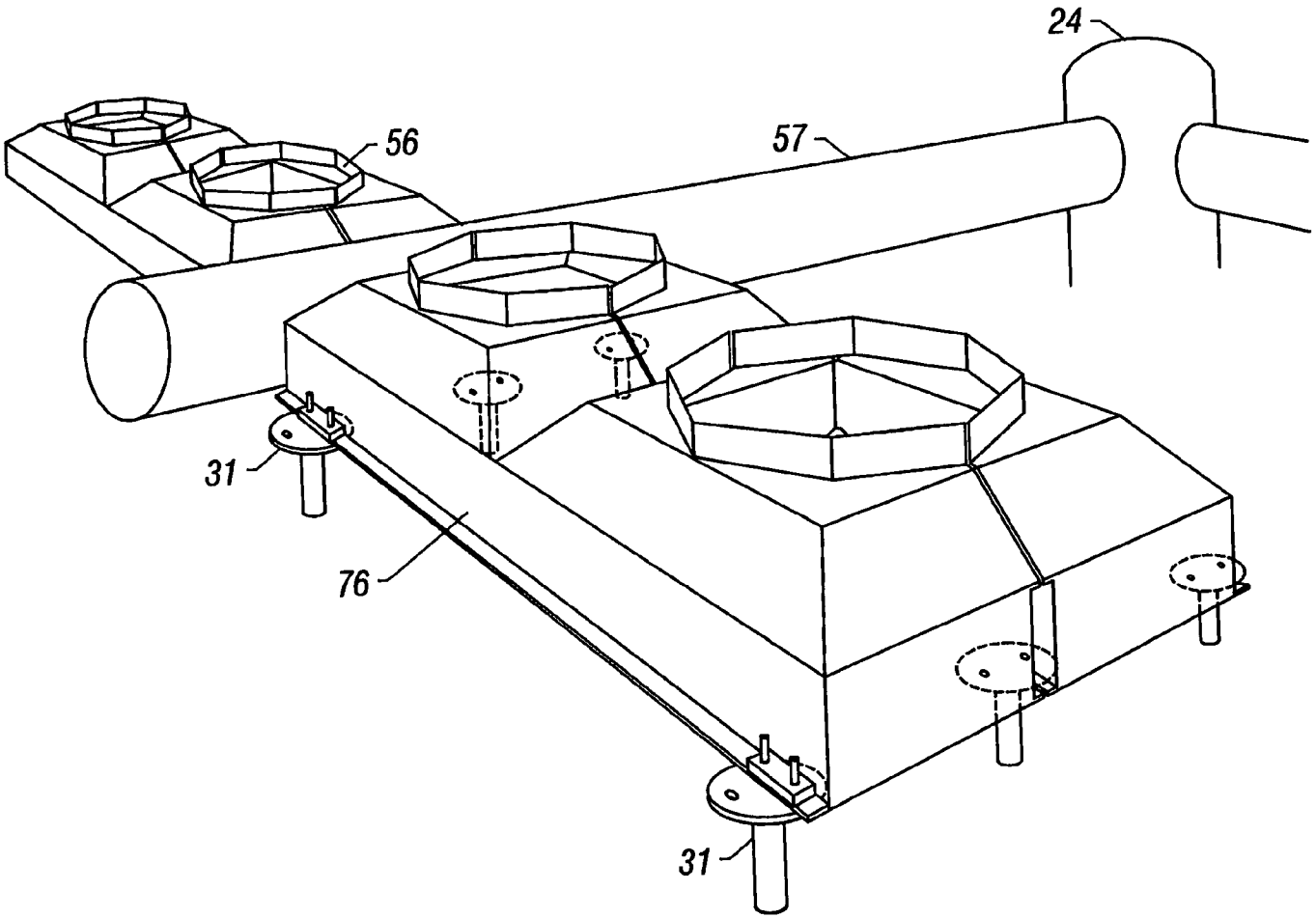
FIG. 8*b* is a side perspective view in partial cutaway showing condenser bays and isolators.
Figure 8C:
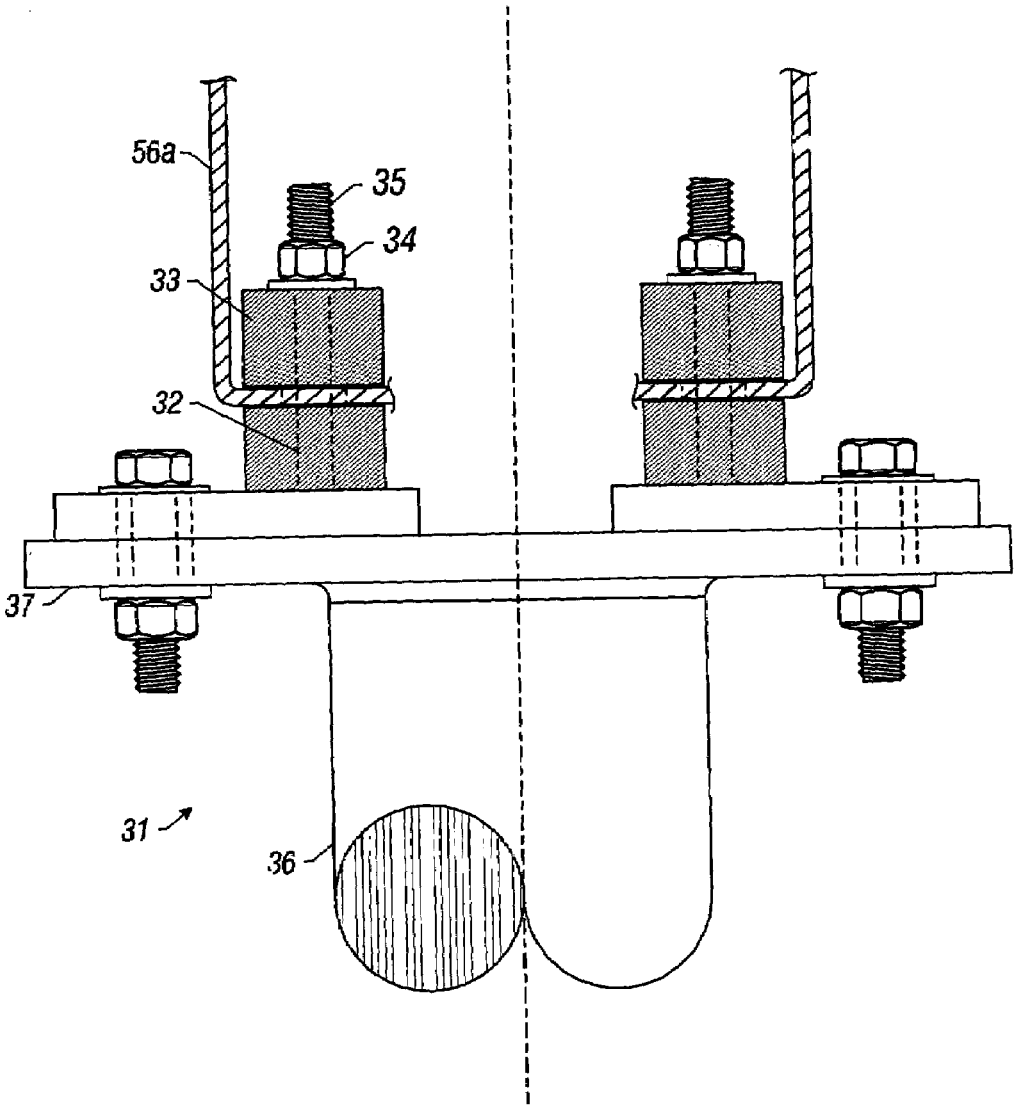
FIG. 8*c* is a plan view of a typical isolator.
Figure 8D:
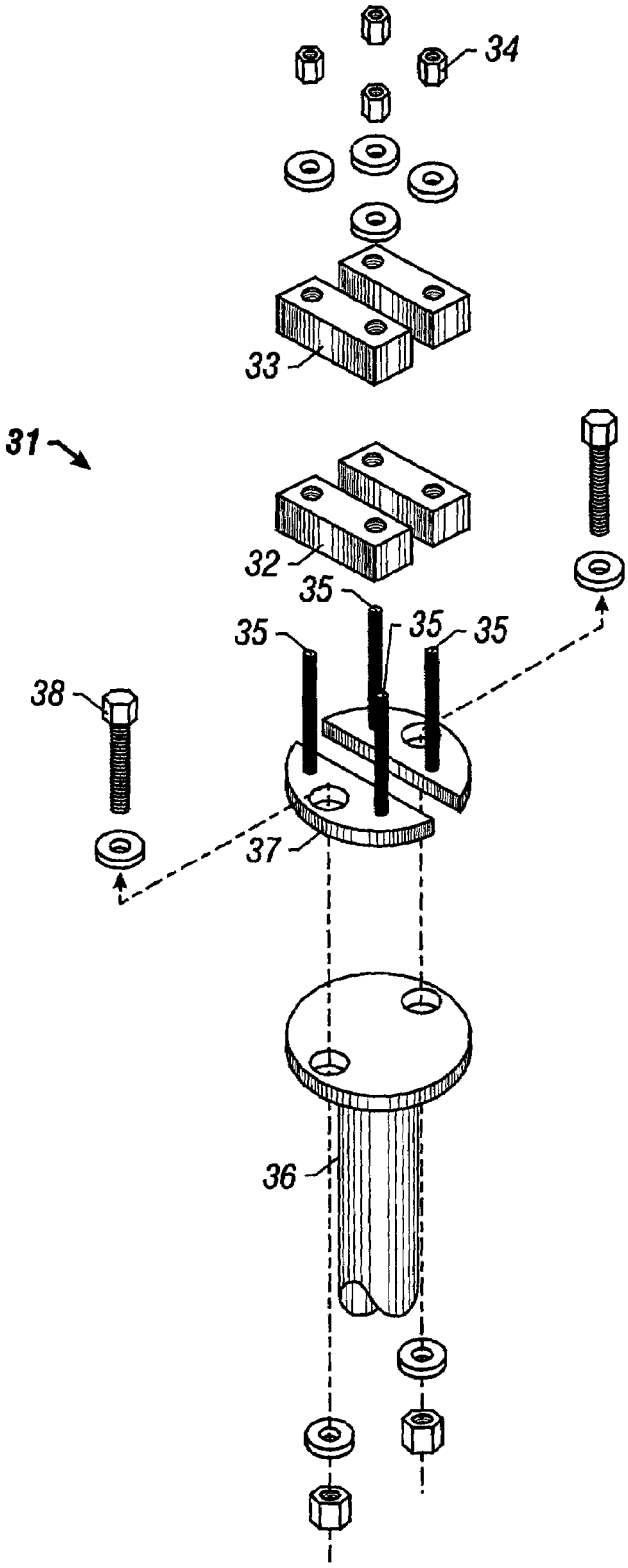
FIG. 8*d* is an exploded view of a typical isolator.

Referring now to FIG. 8*b*, a side perspective view in partial cutaway showing condenser bays and isolators, FIG. 8*c*, a side plan view of isolators, and FIG. 8*d*, an exploded view of a typical isolator, condenser bays 55 are mounted onto support structure 30 using conventional means, as are well known to those in the construction arts, but are isolated from support structure 30 by isolators, generally referred to by the numeral "31." Isolators 31 may comprise isolation pads 32. In a preferred mode, one isolator pad 32 may be placed on each of two sides of condenser bay leg 56*a* which is secured between isolator pads 32 by any means known to those skilled in the construction arts such as by way of example and not limitation nuts 34 and bolts 35, welds, rivets, or any combination thereof. Isolation pads 32 may be made constructed from cork, rubber, plastic, or other suitable material and further aid in reducing noise produced by the operation of cooling fans 50.

Figure 9:
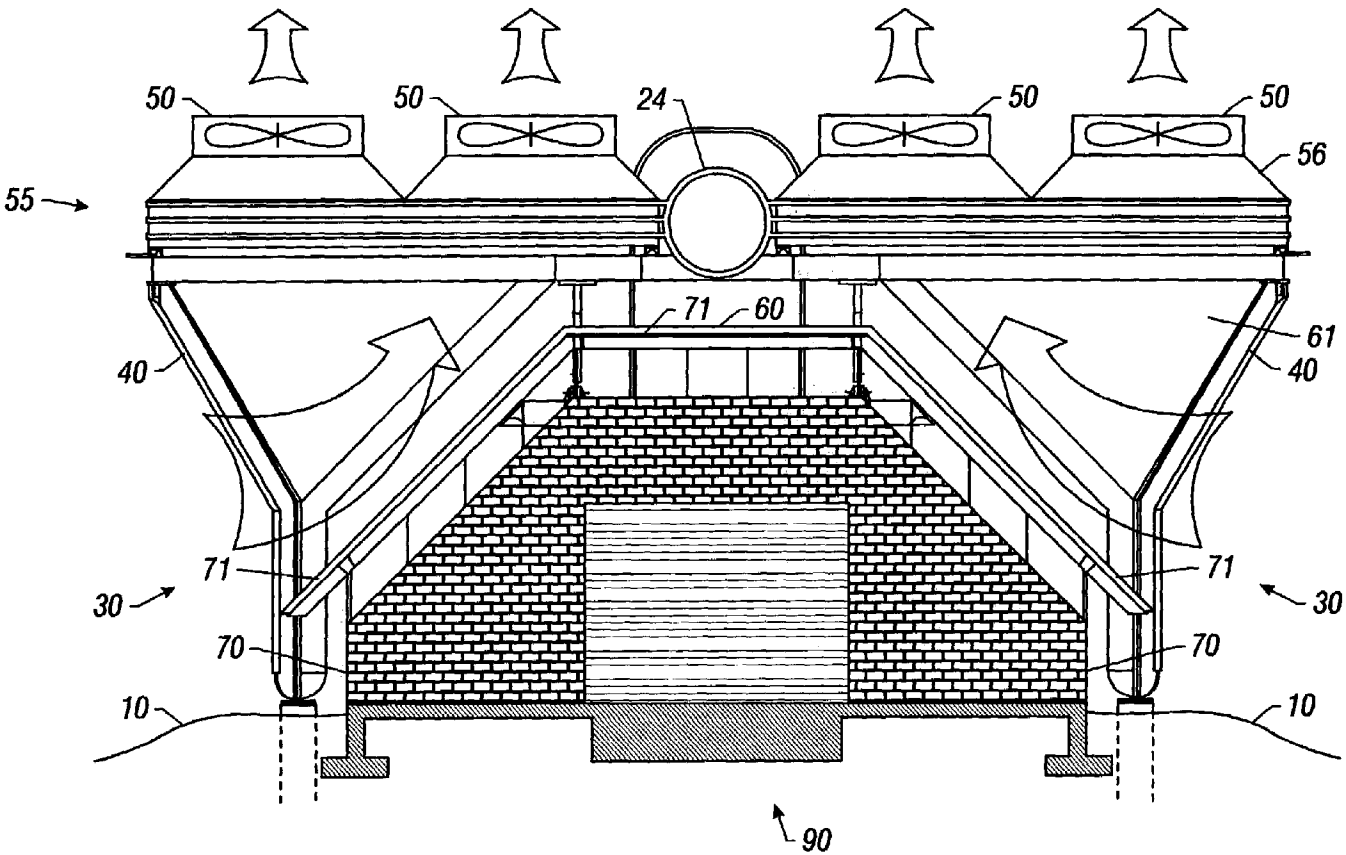
FIG. 9 is a section of a representative configuration of a modular power generation facility showing air flows through condensers mounted on a support structure.

Referring now to FIG. 9, a side view of a representative configuration of power generation facility 1 showing air flows, roof 60, walls 70, and ceiling 71 are shaped to act as one or more guide vanes 61. In a preferred embodiment, air flow is routed via guide vanes 61 through cooling fans 50 and then upward from and perpendicular to cooling fans 50, further aiding in noise control as well as promoting air availability for cooling. Housing 90, comprising walls 70, ceiling 71, and roof 60, is constructed or otherwise placed within support structure 30 such that support structure 30 substantially surrounds housing 90.

In the preferred embodiment, support structure 30 supports the dead weight load of each condenser bay 55 such that support structure 30 resists regional wind and snow loads. Further, in a preferred embodiment, tricolumn legs 40 are of a height sufficient to allow a balanced flow of aid from below. Typically, tricolumn legs 40 are between thirty to fifty feet in height with the preferred range being between forty to forty five feet.

In the preferred embodiment, walls 70 are suspended from support structure 30 and secured onto foundation 10 using any appropriate securing means such as but not limited to bolts, rivets, nails, welding, or any combination thereof. Exterior surfaces of walls 70 may be constructed of appropriate materials such as masonry or otherwise provided with a facade to blend in with the urban surrounding architecture.

Further, in the preferred embodiment, walls 70 and ceilings 71 in each wing 11, especially power wing 11*a*, may be constructed using materials that absorb and contain noise generated by power generation equipment 20. In a preferred embodiment, walls 70 are constructed of brick on an outside portion of walls 70 and sound blocking cinder block, such as will be known to those skilled in the construction arts, to the interior. Ceilings 71 may be constructed of steel or wood or any other appropriate material sufficient to provide protection from anticipated external weather events. Windows (not shown in the figures) may be placed into walls 70 or roof 60 or a combination thereof. In a preferred embodiment, windows are constructed from one-half inch thick glass and positioned near a junction between walls 70 and roof 60 to provide ambient light without presenting an increased environmental load on the interior of wings 11.

Figure 10:
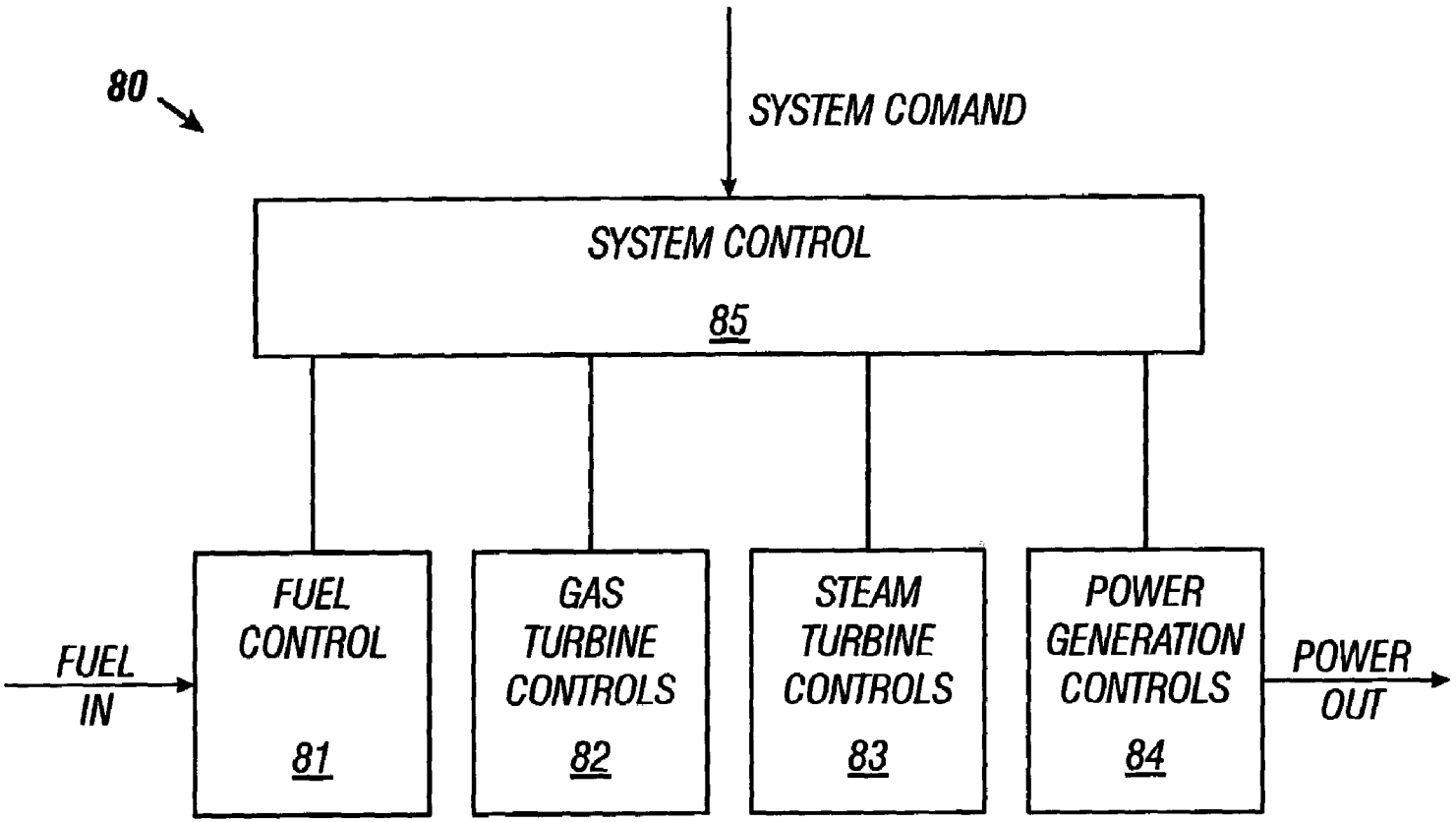
FIG. 10 is a block diagram of automated controls.

Referring now to FIG. 10, a block diagram of control systems, improved power generation facility 1 may be automated using one or more control systems 80 to further lower deployment and running costs. Control system 80 may further comprise monitors and controllers, as will be apparent to those in the control systems arts, such as by way of example and not limitation fuel controller 81, gas turbine controller 82, steam turbine controller 83, and power generation controller 84. A supervisory controller such as system controller 85 may be present to coordinate the other controllers.

Figure 11:
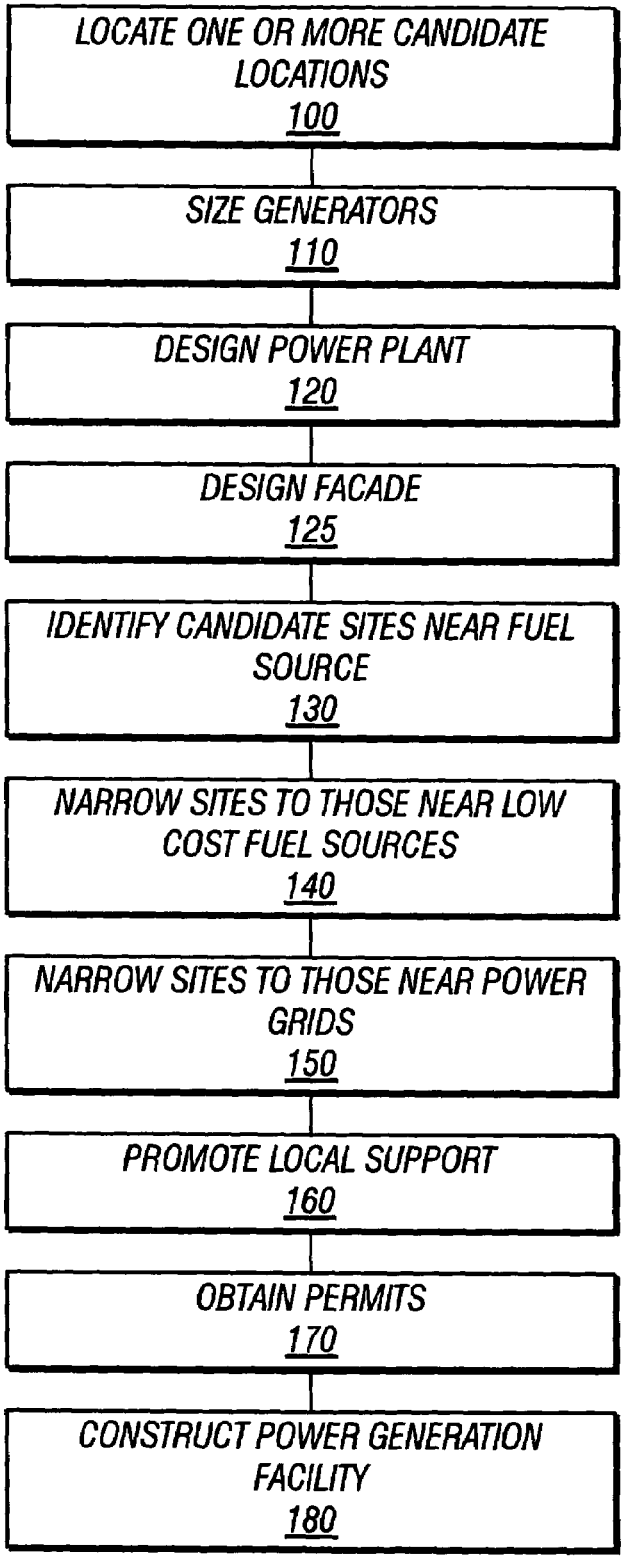
FIG. 11 is a flowchart outlining the method of site selection.
Figure 12:
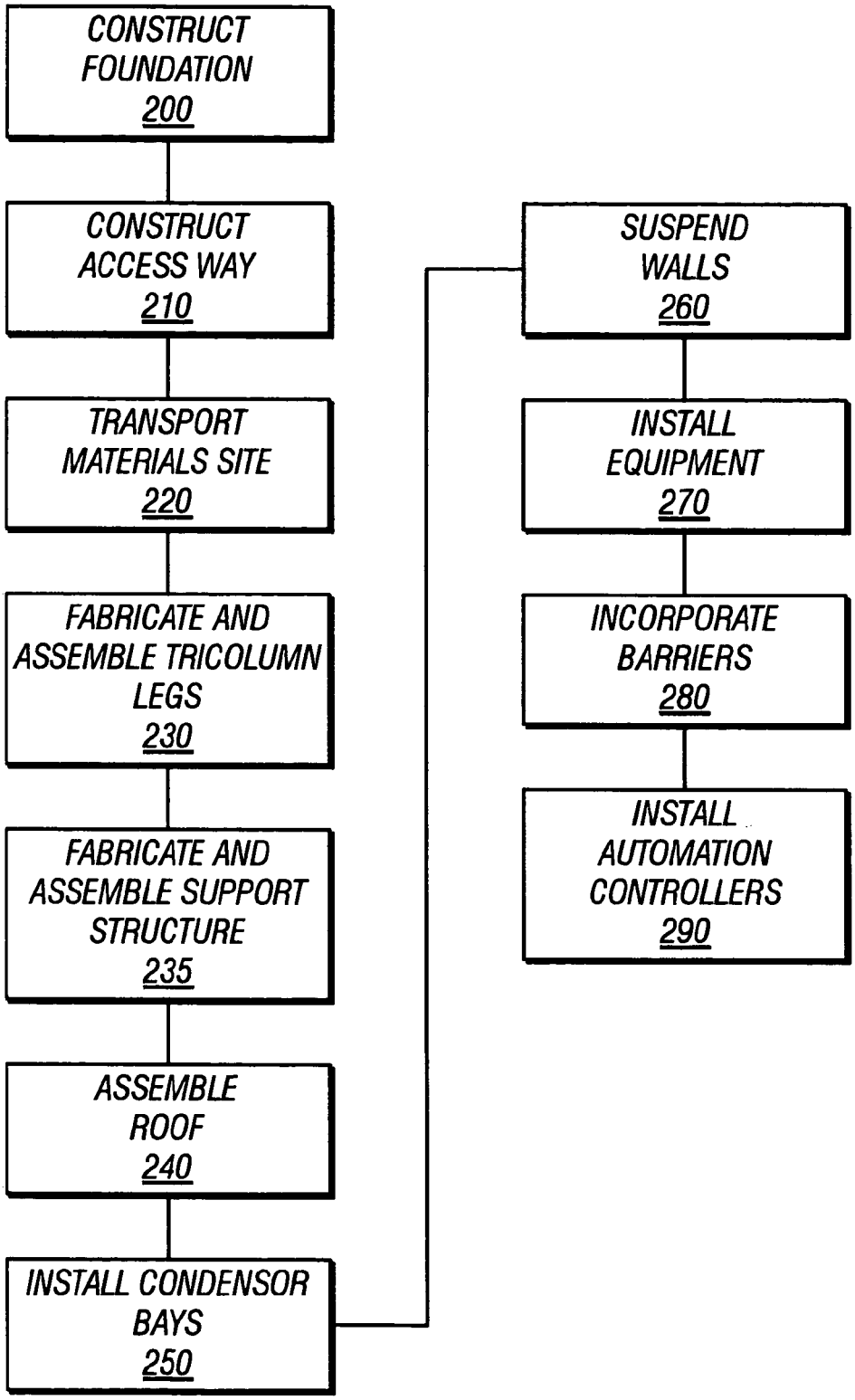
FIG. 12 is a flowchart outlining the method of construction.
Figure 13:
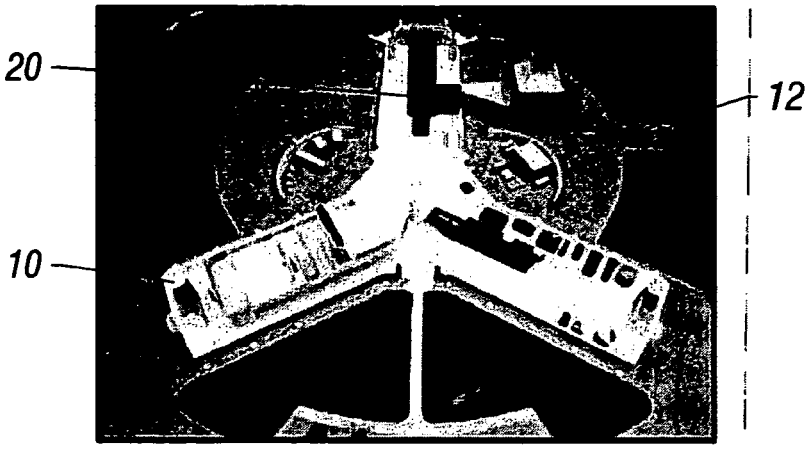
FIG. 13 is a top perspective view of a representative configuration of a modular power generation facility showing construction of a foundation.
Figure 14:
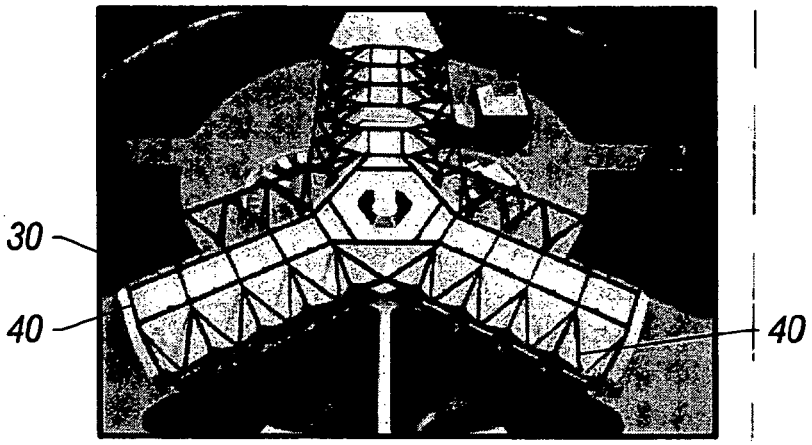
FIG. 14 is a top perspective view of a representative configuration of a modular power generation facility showing placement of tricolumn legs forming a support structure.
Figure 15:
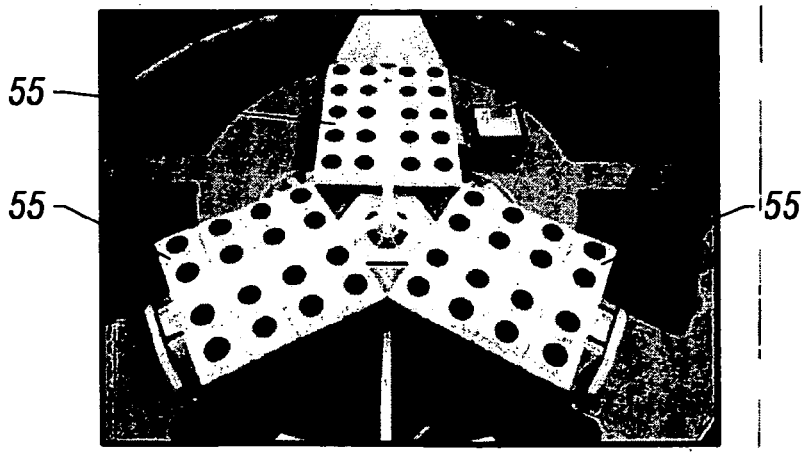
FIG. 15 is a top perspective view of a representative configuration of a modular power generation facility showing placement of condenser bays with cooling fans onto the support structure.

In the operation of the preferred embodiment, referring now to FIG. 11, a flowchart generally outlining the method of site selection for power generation facility 1 is accomplished as outlined within FIG. 11 and more specifically detailed in Applicant's application entitled "Improved Method of Analysis and Physical Location Selection for the Construction and Operation of an Improved Power Generation Facility," filed Jun. 21, 2000 as U.S. patent application Ser. No. 09/598,137, now abandoned and continuation application Ser. No. 10/967,599 filed on Oct. 18, 2004, and specifically incorporated herein by reference.

In general, once power requirements are determined, one or more power generators are sized 110 which will provide power appropriate for the ultimate consumers.

Having sized the power generators required, one or more housings for the one or more power generators are then designed 120, in the preferred embodiment using pre-existing modular housing designs, and a facade for the one or more housings then designed 125 which will blend visually into the general architecture and environment in which the power generation facility is located. In order to gain access to and acceptance by the local community comprising the urban center, power generation facility 1 may be modular as in the preferred embodiment, with outer shells, e.g. outer visible surfaces of walls 70 and/or roof 60, configurable in appearance to blend into the surrounding environment, both architecturally and in operation. Further, power generation facility 1 is of a smaller and more compact scale than traditional power plants. Given its smaller size, functional layout, and configurable facade, acceptance by the local community into an urban setting is enhanced. In the preferred embodiment the entire power generation facility 1, including surrounding landscaping 2, requires no more than nine acres per module in which to be situated.

In the preferred embodiment, each power generation facility 1 is modular, allowing for prefabrication of one or more modules each capable of producing power, further leading to lower costs and more rapid implementation and construction. Further, if so required, power generation facility 1 may begin with a single physical plant module, and other modules may be added at later dates to the existing original power generation facility 1.

In this manner, given its modularity and utilization of lower cost fuels and existing power grids, the improved facility may react quickly and efficiently to changing market conditions and erratic swings in prices of raw fuels and power, and participate in spot markets for power when prices rise because of a lack of fuel or power in a given area or when prices plunge because of an oversupply.

Permits for construction of the power generation facility 1 are then obtained 170, and the power generation facility constructed 180 according to its designs to provide a predetermined power generation output.

Referring now to FIG. 1 and FIGS. 12–15, in the preferred embodiment once a site is selected and requisite approvals and permits obtained, foundation 10 is constructed 200 on the selected site to withstand local conditions such as soil type, earthquake incidence, flooding, and the like. In the preferred embodiment, foundation 10 is constructed of reinforced concrete of a size and spacing appropriate to support power generation equipment 20 and local environmental conditions such as those mentioned herein above.

After or concurrent with the construction of foundation 10, access way 12 may be constructed 210 from an existing thoroughfare such as a nearby street into the physical location and up to where foundation 10 is to be laid, facilitating transportation 220 of the remaining items needed to construct improved power generation facility 1 to the onsite construction area. Pre-fabricated tricolumn legs 40 are brought to physical the location 230 and assembled 235 in place to form supporting structure 30. Any manner of assembly may be used, as those skilled in construction arts will be aware. In the preferred embodiment, pre-fabricated tricolumn legs 40 are assembled to form support structure 30 by bolting tricolumn legs 40 to foundation 10 and to each other, obviating the need for and danger attendant to welding. After being secured to foundation 10, tricolumn legs 40 may then be individually leveled to produce a level support platform.

Roof 60, in the preferred embodiment assembled from a lightweight material such as lightweight steel or wood, is suspended or otherwise placed 240 underneath support structure 30. Additionally, roof 60 may further incorporate sound material such as lead laminated between two sheets of plastic or other materials well known to those skilled in the architectural or construction arts.

Condenser bays 55, including fans 50, are installed 250 upon support structure 30. In the preferred embodiment, walls 70 are suspended 260 from support structure 30, and then power generation equipment 20 installed 270. In alternative embodiments, all walls 70 but for one or two may be installed to leave adequate access for placement of power generation equipment 20 into power generation facility 1.

In the prior art, construction of a power generation facility begins with the foundation and installation of power generation equipment upon the foundation, with the surrounding structures added last. In the method, described herein, and due in part to the modular nature of power generation facility 1, initially constructing access way 12, foundation 10, support structure 30, and walls 70 allows a more rapid implementation of a surrounding protective shell, further allowing installation of power generation equipment 20 even in inclement weather due to the sheltering nature of support structure 30 and walls 70 and the more tolerant access way 12 (as opposed to, for example, a dirt path).

As an additional benefit to the method, described herein, of constructing a power generation facility 1, power generation equipment 20 costs—usually a highly significant and substantial portion of the overall cost of construction—can be delayed until long into the construction cycle, thus lessening the actual cost to implement power generation facility 1. When completed, power generation facility 1 may incorporate 280 barriers 2 such as but not limited to landscaping to further blend into its surroundings. Further, once completed, one or more controls for partially or fully automating control 290 of power generation facility 1 in a manner familiar to those skilled in the power generation automation arts.

Once constructed, power generation facility 1 may be brought online to meet power requirements of a local community or a power distribution grid network and taken offline when those requirements abate. Use of lower cost fuels as well as appropriate power generation equipment 20 such as gas turbine-generator set 21 and steam turbine-generator set 22 allows for start-stop operation of power generation equipment 20. This versatility allows more economic construction and operation of power generators due to the ability of improved power generation equipment 20 to ramp on and off quickly and/or produce variable amounts of power. Further, the modular approach embodied herein allows for incremental production of power as well as incremental construction of power generators.

Figures 16, 16A:
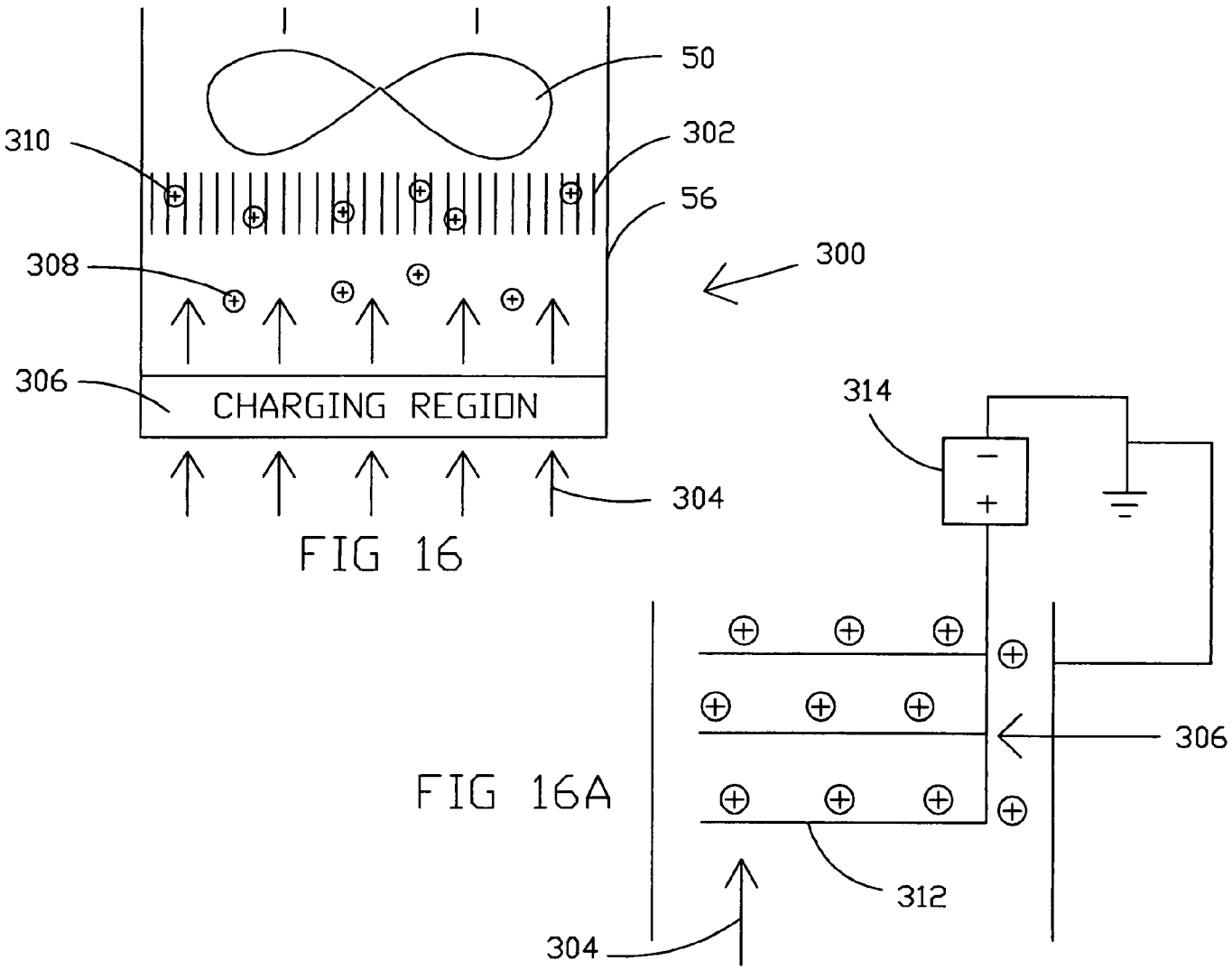
FIG. 16 is a schemmatical elevational view showing conceptual operation of an electronic air cleaner module in conjunction with charged cooling fins and a single cooling fan.
FIG. 16A is a schemmatical of one possible embodiment and type of charging region for an electronic charging region.

FIG. 16 shows a electronic air cleaner module 300 which may be mounted within each condenser module 56 wherein a plurality of cooling fans 50 are mounted therein as discussed hereinbefore. Steam and/or gas from central manifold 24 and steam manifold 57 flows through a plurality of electrically insulated cooling fins 302 mounted within each condenser module 56.

While a particular embodiment of an electronic air cleaner module 300 is shown, it will be understood there are many possible embodiments that may be used herein. Air flow 304 directed through each condenser module 56, as shown for instance in FIG. 9, may be directed into charging region 306. Charging region 306 provides means for charging particles that flow therethrough. Various types of charging regions may be utilized, if desired, to charge the particles that flow through charging region 306. For instance, charging region may utilize corona electrification, contact, triboelectrification, indiction and polarization in an electric field, or any combination thereof. In other embodiments, charging region 306 may be eliminated and/or replaced by or combined with use of electric fields may be used as described hereinafter, or multiple electric fields. In essence, the presently described embodiment charges particles flowing through charging region 306 whereby the flowing charged particles, as indicated at 308, are attracted to oppositely charged surfaces of cooling fins 302 where the particles stick as indicated at 310.

FIG. 16A shows one possible means for charging particles within charging region 306. Corona wire or a grid of corona wires 312 may be kept at a high potential by means of high voltage power supply 314. Positive ions are created and are drawn towards negative surfaces from corona wire or grid 312 whereby a region of concentrated positive ions is created. When dirty air in air flow 304 with particulates therein, such as various types of pollution, pollen, and the like, flows through charging region 306, the ions will tend to attach to the particles in the air. Charging region may be positioned at any desired position below or within condenser modules 56, such as the flow path indicated in FIG. 9, whereby air flow 304 must flow therethrough.

Airflow 304, wherein the particles are now charged positively now flow through negatively charged cooling fins 302 whereby the charged particles will be attracted to the cooling fins. The cooling fins tend to be rather close together, have a large surface area, and are designed to absorb heat from the air so that the charged particles are likely to land on the fins. The design for absorbing heat is also conducive to attract charged particles once cooling fins 302 are charged.

Figure 17:
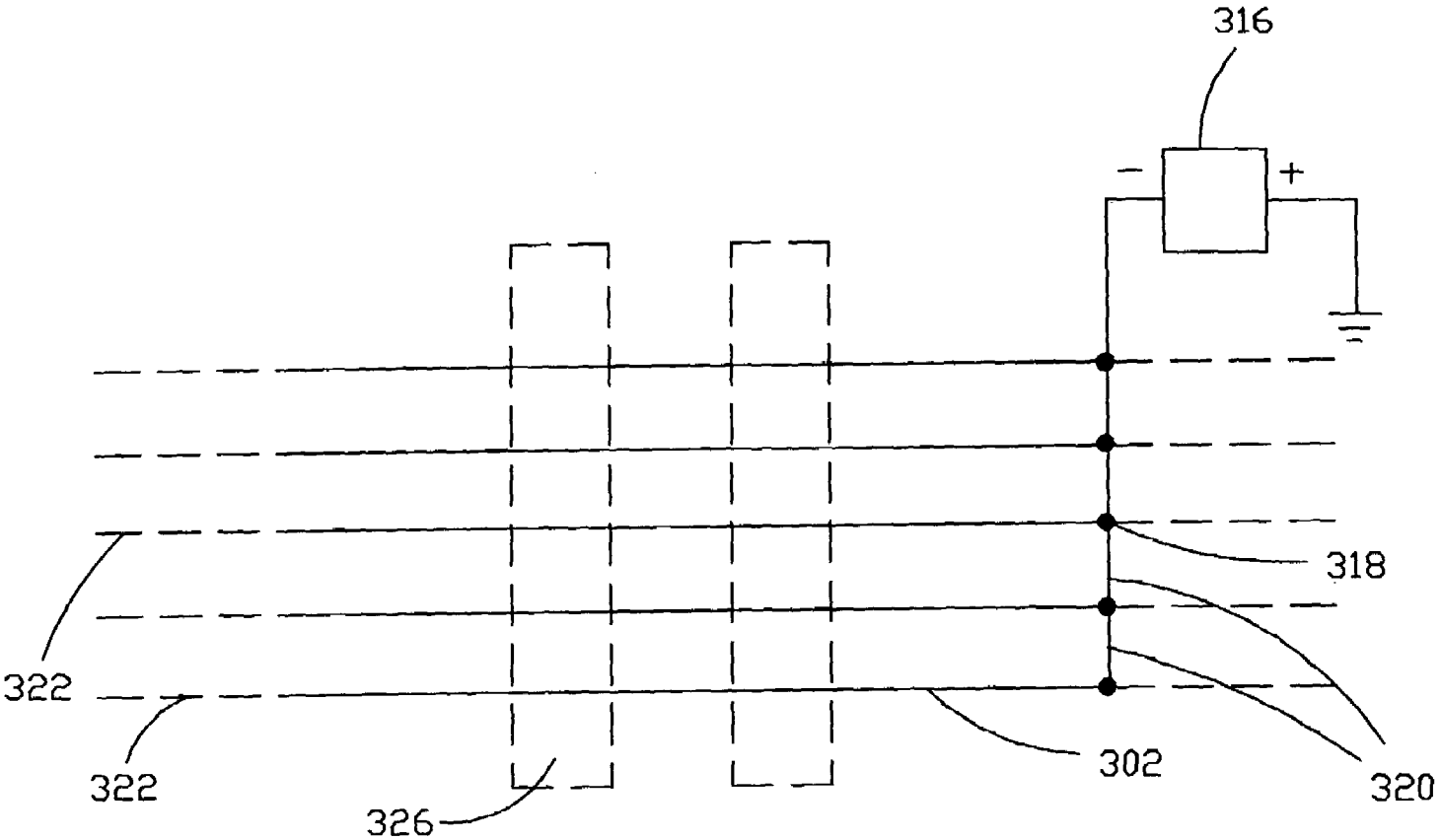
FIG. 17 is a schemmatical plan view of a grid of charged cooling fins.
Figure 19:
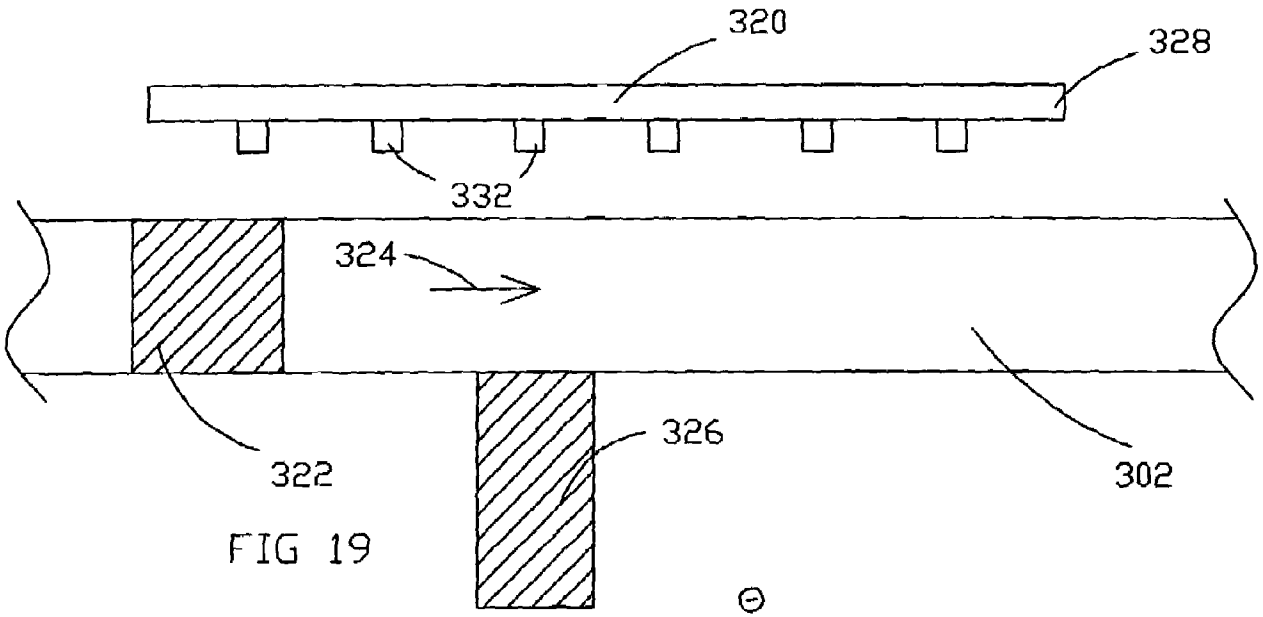
FIG. 19 is an elevational view showing insulative construction for cooling fin lines.

FIG. 17 shows one possible electrical configuration for cooling fins 302. In this embodiment, cooling fins 302 are electrically connected to negative voltage produced by negative power supply 316. Electrical connections 318 and associated wiring 320 place metallic cooling fins 302 at a negative voltage whereby positively charged particles are attracted thereto. Cooling fins 302 are therefore insulated and may include insulated portions 322 made of insulative material. For example, in FIG. 19 cooling fin 302 is fed with heated steam or gas to be cooled as indicated at 324 through insulation section 322 which connects to metallic cooling fin 302. As well, insulative supports 326 as shown in FIGS. 17 and 19 may be utilized to physically support cooling fins 302 in a suitable manner.

The filtering efficiency of electronic filter 300 may be adjusted by controlling the relative voltages of corona wire 312 and cooling fins 302. In one embodiment, corona wire 312 may be at a relatively high voltage (300 to 2000 volts above ground potential) whereas cooling fins 302 may be at a relatively low voltage (−100 to −300 volts). These ranges may be increased or varied as desired and may be controlled depending on the types of pollution, the condition of the cooling fins (clean or dirty) and so forth as desired. If desired, the power supply may be different supplies or power supply 314 and 316 may comprise the same power supply with different outlets and connections.

Figure 18:
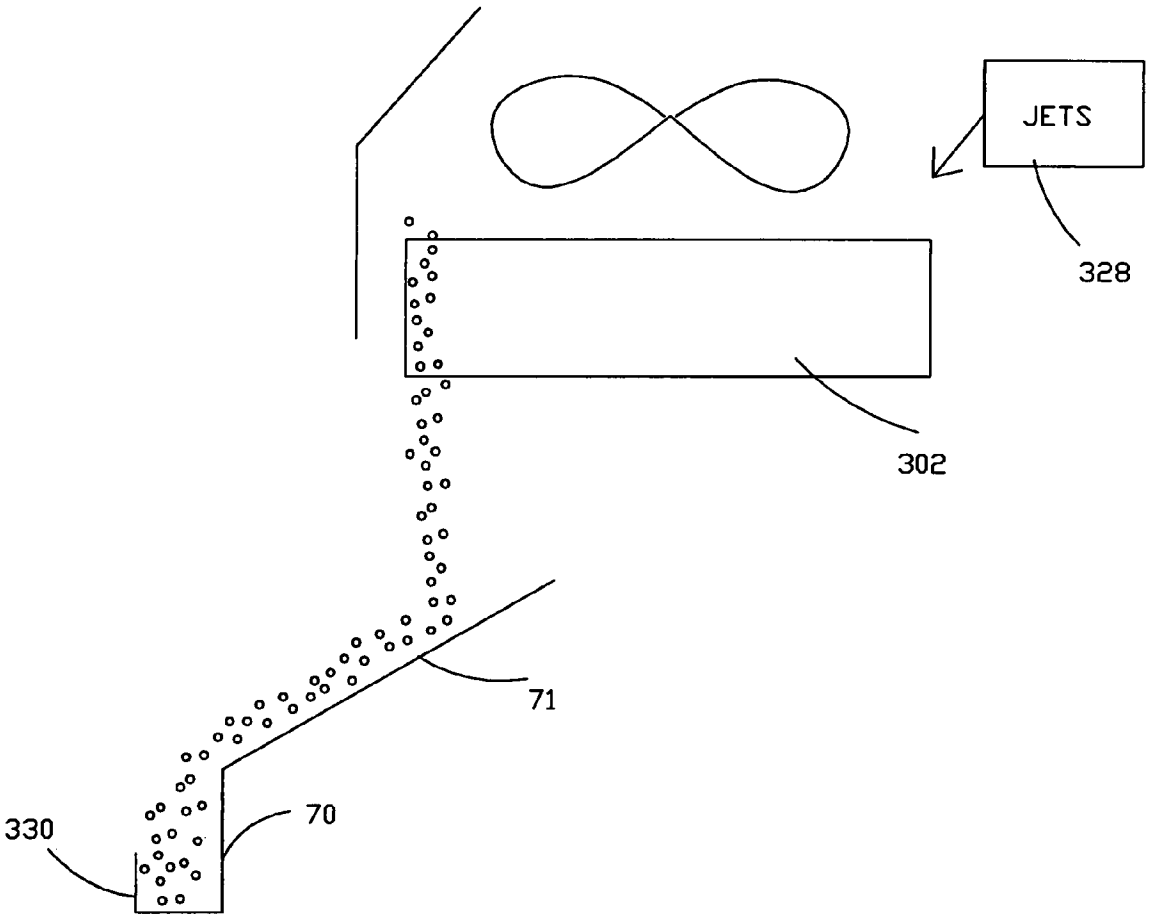
FIG. 18 is a schemmatical showing a cleaning operation of the cooling fins to remove captured particulates.

To clean cooling fins 302 for removing the trapped particulates, as in FIG. 18, cleaning fluid or water may be sprayed or jetted onto cooling fins 302 as indicated at 328. The jets may wash fluid down ceiling 71 and walls 70, shown in more detail in FIG. 9, and into gutter or tank 330. The particles may then transported or directed to the sewer system. In FIG. 19, a jet spray is shown mounted above cooling fins 328. High pressure fluid may be produced in cleaning manifold 330 and high pressure jets 332 may spray fins 302 to clean the trapped particulates therefrom. The cleaning jets may be of many constructions as desired for efficient cleaning. The cleaning jets may be mounted for movement and may be directable or rotating.

Since the generating of power may be operational at some times and shut down at other times, cleaning of the cooling fins 302 may be performed during times when the generator is not operating. Alternatively, if some condenser modules 56 are not needed during off peak generation, then those modules may be cleaned. It will be noted that even during cleaning of cooling fins 52, due to cleaning water flow, some cooling may be provided for the hot steam or gases.

Figure 20:
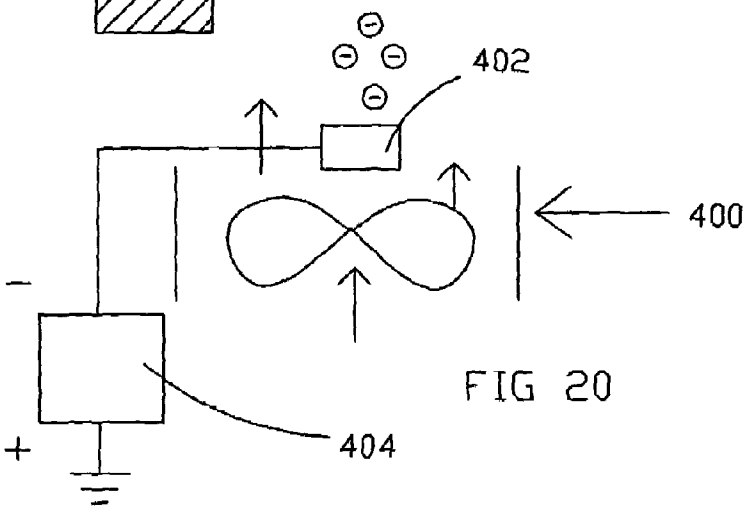
FIG. 20 is a schemmatical view for an ionizer.

FIG. 20 discloses ion generator 400 which may be utilized with or without electronic air cleaner module 300. Ion generator 400 may comprise, in one preferred embodiment thereof, one or more needle electrodes mounted within negative ion generator element 402 which are negatively charged utilizing power supply 404. Negative ion generator element 402 may also include a washing means for washing the needle electrodes as necessary. The negative ions, which may be created in large quantities, are then blown upwardly by fans 50. This results in air being moved upwardly in columns which may extend hundreds of feet into the air. Negative ions are produced by lightening and many people find that negative ions are healthful. Thus, if desired, one component or embodiment may also be utilized as a large scale negative ion fountain which may be turned on or off as desired. Ion generator element 402 may be comprised of any type of suitable negative ion generators capable of producing sufficient negative ion output and may be produced by electric discharge or the like, if desired.

In another embodiment, the construction of fins 302 may provide coatings or the like of materials that may be used as catalysts for reacting with pollutants of various types for removing the same from the air.

It may be seen from the preceding description that an improved power generation facility and method have been provided.

It is noted that the embodiment of the improved power generation facility and method described herein in detail for exemplary purposes is of course subject to many different variations in structure, design, application and methodology. Because many varying and different embodiments may be made within the scope of the inventive concepts herein taught, and because many modifications may be made in the embodiment herein detailed in accordance with the descriptive requirements of the law, it is to be understood that the details herein are to be interpreted as illustrative and not in a limiting sense.

What is claimed is:

1. An electronic air cleaner module for a power generation facility, comprising:

a manifold operable for conducting heated gas from an electric power generator;

a plurality of electrically insulated cooling fins connected to said manifold for receiving said heated gas;

an air flow path through said cooling fins;

a plurality of fans to move air along said air flow path through said cooling fins; and a first power supply for applying a first voltage to said cooling fins.

2. The electronic air cleaner of claim 1 further comprising a charging section operable for producing ions to charge particulates within said air flow.

3. The electronic air cleaner of claim 2 wherein said charging section comprises a plurality of wires, and a second power supply to apply to said plurality of wires a second voltage of opposite polarity to said first voltage.

4. The electronic air cleaner of claim 2 wherein the first voltage is negative with respect to ground and the second voltage is positive with respect to ground.

5. The electronic air cleaner of claim 1, further comprising a negative ion generator.

6. The electronic air cleaner of claim 1 wherein each of said plurality of fans has a diameter over twenty feet.

7. The electronic air cleaner of claim 1, further comprising a flow tube for interconnecting said plurality of cooling fins with said manifold to permit said heated gas to flow from said manifold to said plurality of cooling fins, said flow tube being comprised of electrical insulation material.

8. The electronic air cleaner of claim 1, further comprising one or more cleaning jets for removing particulates from said plurality of cooling fins.

9. A method for an area wide electronic air cleaner, comprising:

heating gas with an electrical generator capable of producing power;

directing said gas to flow within a plurality of cooling fins for removing heat from said gas;

rotating a plurality of cooling fans to direct a large air mass flow through said cooling fins for removing said heat from said cooling fins;

electrically insulating said cooling fins; and applying a voltage to said cooling fins to attract charged particles in said air mass flow such that said charged particles are attracted to a surface of said plurality of cooling fins.

10. The method of claim 9, wherein said electrical generator is capable of producing over 150 megawatts of power.

11. The method of claim 9, further comprising producing ions within said air mass flow to thereby create said charged particles.

12. The method of claim 11, further comprising electrifying one or more wires to thereby produce a plurality of ions.

13. The method of claim 9, further comprising washing said plurality of cooling fins with a pressurized fluid to remove said charged particles from said cooling fins.

14. The method of claim 9, further comprising producing negative ions at a position above said plurality of cooling fans.

15. A method for treating environmental air flowing through a power generating plant, comprising:

providing a turbine generator;

directing gas heated by said turbine generator to a plurality of cooling fins;

mounting a plurality of cooling fans above said plurality of cooling fins to create an air that flows through said cooling fins;

mounting a negative ion generator above said cooling fans for producing ions to be carried by said air flow above and away from said cooling fans.

16. The method of claim 15, further comprising electrically insulating said cooling fins and applying a voltage to said cooling fins.

17. The method of claim 15, further comprising charging particles in said air flow prior to reaching said cooling fins.

18. A method for treating environmental air, comprising:

providing a plurality of electrically insulated metal fins;

mounting a plurality of fans adjacent said plurality of electrically insulated metal fins;

providing an opening above the ground to provide an input for air flow path through said electrically insulated metal fins and said plurality of fans;

rotating said plurality of fans to create a large air flow of environmental air from said opening that flows in said air flow path through said electrically insulated metal fins; and producing an electric field utilizing said electrically insulated metal fins to attract particulates to said electrically insulated metal fins.

19. The method of claim 18, further comprising providing that said plurality of fans is at least six or more fans each having a diameter of over ten feet.

20. The method of claim 18, further comprising providing that said opening above ground is within thirty feet or less of the ground.

21. The method of claim 18, further comprising charging particles in said air flow prior to reaching said electrically insulated metal fins.

22. The method of claim 18, further comprising providing that each of said plurality of fans has a diameter over twenty feet.

23. The method of claim 18, further comprising providing that said electrically insulated fins are cooling fins for cooling a fluid utilizing said large air flow.

24. The method of claim 23, wherein said fluid comprises heated gas produced by an electrical generator.

* * * * *